US008607988B2

(12) United States Patent
Meile et al.

(10) Patent No.: US 8,607,988 B2
(45) Date of Patent: Dec. 17, 2013

(54) SCREENING MACHINE

(75) Inventors: Andreas Meile, Kirchberg (CH); Christof Kaufmann, Niederuzwil (CH)

(73) Assignee: Bühler AG, Uzwil (CH)

( * ) Notice: Subject to any disclaimer, the term of this patent is extended or adjusted under 35 U.S.C. 154(b) by 153 days.

(21) Appl. No.: 13/124,453

(22) PCT Filed: Oct. 16, 2009

(86) PCT No.: PCT/EP2009/063608

§ 371 (c)(1), (2), (4) Date: May 20, 2011

(87) PCT Pub. No.: WO2010/043712

PCT Pub. Date: Apr. 22, 2010

(65) Prior Publication Data

US 2011/0259800 A1 Oct. 27, 2011

(30) Foreign Application Priority Data

Oct. 16, 2008 (DE) ..... 10 2008 042 916

(51) Int. Cl.
*B07B 1/46* (2006.01)

(52) U.S. Cl.
USPC ..... 209/400; 209/401

(58) Field of Classification Search
USPC ..... 209/400, 401, 931
See application file for complete search history.

(56) References Cited

U.S. PATENT DOCUMENTS

| | | | | |
|---|---|---|---|---|
| 5,977,782 | A * | 11/1999 | Kordecki | 324/700 |
| 5,996,807 | A * | 12/1999 | Rumpf et al. | 209/401 |
| 6,585,116 | B1 | 7/2003 | Klaus et al. | |
| 6,997,325 | B2 * | 2/2006 | DeCenso | 209/401 |
| 7,913,853 | B2 * | 3/2011 | DeCenso et al. | 209/405 |
| 2009/0000994 | A1 * | 1/2009 | Kato et al. | 209/363 |

FOREIGN PATENT DOCUMENTS

| | | |
|---|---|---|
| CN | 2288786 | 8/1998 |
| DE | 6751332 | 2/1969 |
| DE | 2326306 | 12/1973 |
| DE | 2443548 | 3/1976 |
| DE | 2847153 C3 | 2/1982 |
| DE | 3143779 | 7/1982 |
| DE | 4324066 | 1/1995 |
| EP | 1806185 | 7/2007 |
| JP | 11-290781 | 10/1999 |
| JP | 2008-006383 | 1/2008 |
| JP | 2008-224261 | 9/2008 |

* cited by examiner

*Primary Examiner* — Joseph C Rodriguez
(74) *Attorney, Agent, or Firm* — Shoemaker and Mattare

(57) ABSTRACT

The invention relates to a screen for a screening machine for screening a product into two fractions. To avoid detrimental effects to the quality of the product due to damage at the screen mesh of a screen (9), the screen is provided with a metal layer, in particular in the manner of a conduction path, wherein the electrical resistance of said layer is measured and wherein changes in the resistance indicate damages.

9 Claims, 3 Drawing Sheets

SCREENING MACHINE

The invention relates to a screen for a screening machine for screening a product into at least two fractions.

Screening machines and screens, in particular for separating floury products or for cleaning bran, are known per se. Depending on the type of screen, a finer fraction can pass through the screening cloth (screen underflow), while the coarser fraction is discharged as screen reject. Cloths of synthetic material or meshes of metal wire are used as screen gauze for screening flour.

In particular when screening flour, any mixing in of coarse fractions with the product falling through should be avoided, and so tears or ruptures in screening cloths, in particular of synthetic materials, that are caused by wear must be detected at an early time. In the simplest form, this takes place by continually performing manual checks.

A method for contactlessly and nondestructively measuring the abrasion of a screen has already been proposed in DE-A-1648368. For this purpose, radiation should be directed onto the screening cloth and the proportion that is reflected measured. The measured value should be a function of the remaining thickness of the screen or of the absolute abrasion of the wires of the screen web, i.e. in particular metal wires. When a limit value is reached, a signal indicating that the screen needs to be changed should be triggered.

In the case of a screening device according to DE-A-4324066, a screening cloth of synthetic fibers additionally has in one direction electrically conductive filaments, in particular carbon fibers, which are spaced apart laterally from one another and are attached to the screen under tension in the axial direction. Monitoring for faults (for example screen rupture) should be reliably made possible by conductivity measurements. The electrically conductive fibers form an arrangement of electrodes, the conductivity of which changes if at least one filament ruptures, which is used as a detection signal. Damage to the synthetic fibers, in particular longitudinal tears, sometimes cannot be detected at all, or too late. It is also proposed that other physical parameters can also be used analogously.

It is known from DE-U-6751332 and DE-A-2326306 to surround cloths of synthetic materials completely with metallic layers, in particular of silver or copper, in order in this way to increase the strength and stiffness of these cloths. The thicknesses of the layers are in this case about 20-100 μm. DE-C-3227020 discloses the adhesive attachment of insulated wire filaments to a screen; DE-A-2443548 discloses the incorporation of electrical control filaments in webs of material. It is stated in DE-A-4324066 that such filaments can lead to a hardening of the cloth, and consequently to increased susceptibility to rupture.

The invention is based on the object of providing a screen for a screening machine which makes it possible for tears or ruptures in the screen (in particular of synthetic fibers) to be detected more easily and dependably. The object is achieved by the features of the independent patent claims.

A screen according to the invention has a screening area of synthetic material, preferably of synthetic fibers. Synthetic materials are understood here and hereafter as meaning materials of which the main constituents consist of such macromolecular organic compounds that are obtained synthetically or by modifying natural products. The screening area may preferably be a screening cloth of synthetic material; however, a screening area with through-openings that is not formed by a cloth (for example on the basis of holes punched into a sheet-like formation) may be used according to the invention. The screening area or the screening cloth is at least partially provided here with an electrically conductive layer, in particular a metallic layer.

The electrical conductivity of metals, which are preferably used as the electrically conductive layer, is generally greater by several orders of magnitude than that of synthetic materials. The electrically conductive layer makes it possible to measure the electrical resistance along this layer continuously or periodically. It has been found that the electrical resistance can be used very reliably as a criterion for the quality of the screen, since damage to the screen structure results in a measurable change in the electrical resistance. Damage to the screen structure is understood here as meaning in particular both the formation of tears and the complete severing of the delimitations of the through-openings of the screen—in particular of warp/weft threads—as well as wearing (reduction in thickness). Screen wear and incipient destruction as a result of damage or penetration of the screening cloth (a hole, tear or rupture) can be detected.

Within the scope of the invention, the following are preferred as the synthetic material of the screening cloth, in particular as synthetic fibers of the screening cloth:

polyamides (PA), in particular
PA6,
PA66,
polyalkylenes, in particular
polyethylene (PE), preferably of high density (HDPE),
polypropylene (PP),
polyethylene/polypropylene copolymers (PE/PP);
polyesters, in particular
polyethylene terephthalate (PET) and
polybutylene terephthalate (PBT).

In preferred embodiments, the metal(s) of the electrically conductive layer is/are selected from the group comprising silver, titanium, chromium and mixtures thereof. Silver is particularly preferred here on the basis of the extremely high conductivity of $61\times10^6$ S/m, since the detectable absolute changes in the conductivity are greater as a result.

Also preferably, the electrically conductive layer is not formed over the full surface area of the screening area, in particular the screening cloth. In particular, it is possible for a coating to be only in partial regions that are particularly subjected to loading.

It has been found that, in the case of resistance measurement on a screen provided with the electrically conductive layer substantially over its surface area, a screen rupture results only in changes in resistance of the order of magnitude of a few ‰, depending on the position and size of the damage. Although effects of this order of magnitude can readily be measured, under some circumstances they may be overlaid by disturbing influences during the operation of a screening machine.

Surprisingly, and most particularly preferably, the invention can be further improved by the electrically conductive layer being formed as a conductive track. Conductive tracks are understood here and hereafter as meaning electrically conductive connecting paths between defined points. The resistance measurement is thereby made much easier, since, with suitable arrangement of the conductive track, it only remains necessary to distinguish qualitatively between "conductive" and "non-conductive".

In this case, the conductive track is preferably arranged in such a way that it runs substantially at an angle≠0° in relation to the delimitations of the screen openings, in particular at an angle≠ 0° in relation to the warp threads and/or weft threads of the cloth of synthetic material; "substantially" means here that, in particular in regions where there is a reversal in the direction of the conductive track arranged for example in a meandering manner, in limited partial regions it is possible in particular for it to be arranged along warp threads and/or weft threads. In particular embodiments, the conductive track is formed in such a way that it runs substantially at an angle of approximately 30° to approximately 60° (preferably at an angle of approximately 45°) in relation to the delimitations of the screen openings, in particular in relation to warp threads and/or weft threads of the cloth of synthetic material. With a suitable arrangement of the conductive track, and in particular also the width of the conductive track, damage can be detected in all directions, in particular longitudinally and/or transversely in relation to the direction of the weft/warp threads. The conductive track may, in particular, be arranged in such a way that detection of damage is possible if it corresponds in its extent to at least the mesh width (in particular at least two meshes in the case of tearing of a filament), in order to avoid greater damage to the screening cloth, and consequently detrimental effects on the screening result.

In particularly preferred embodiments, the electrically conductive layer is homogeneously formed, that is to say in particular with regard to the material, the structure, the thickness and/or the width (individually or in combination).

A screen according to the invention may be formed in particular as a round screening jacket, in which a beater mechanism can be rotatably arranged.

Suitable methods for producing a screen described above are known per se. Methods for applying metallic layers to cloth (for example by vapor deposition, sputtering (cathodic sputtering) or plasma spraying (PVD)) according to step ii) are known in particular from EP 925 196 B1; the disclosure in this respect is included by reference in the description of the present invention.

A screen according to the invention as described above is used in particular in a screening machine. A further aspect of the invention therefore concerns a screening machine, containing a screen as described above. Screening machines are understood in this connection as meaning in particular drum screening machines and plansifters.

A further aspect of the invention concerns a method for operating a screening machine, the electrical resistance of the electrically conductive, in particular metallic layer being measured continuously or periodically. The resistance measurement may in this case take place with constant current or constant voltage. The quality of the screen can then be determined on the basis of the electrical resistance measured.

In a further aspect, the invention also concerns a method for maintaining a screening machine, comprising the step of exchanging a screen as described above that is damaged or worn for a screen that is not damaged or worn, in particular as described above.

It has also been found that the coating (in particular coating over the full surface area) may already be suitable for reducing the wear on the screening cloth.

The screen is preferably stretched in the radial direction. Both round or drum screens and flat, planar screens are detectable. In the case of a screen according to the invention, the screening area or the screening cloth is, in particular, fastened to a frame, preferably stretched on a frame. The screen may preferably also be equipped with electrical terminals (for example sockets, plugs, or the like), by way of which the resistance measurement is made possible, in particular along the conductive track.

It has been found that influencing of the resistance measuring results by environmental and operational influences, such as in particular temperature or vibration influences, can be readily compensated by routine measures.

The screen according to the invention may also be used in structural openings of silos or mills, for example by stretching it over windows in order to allow damage to these openings to be detected.

The invention is explained in more detail below on the basis of exemplary embodiments and figures, without the subject matter of the invention being restricted to these exemplary embodiments. In the figures.

Figure 1:
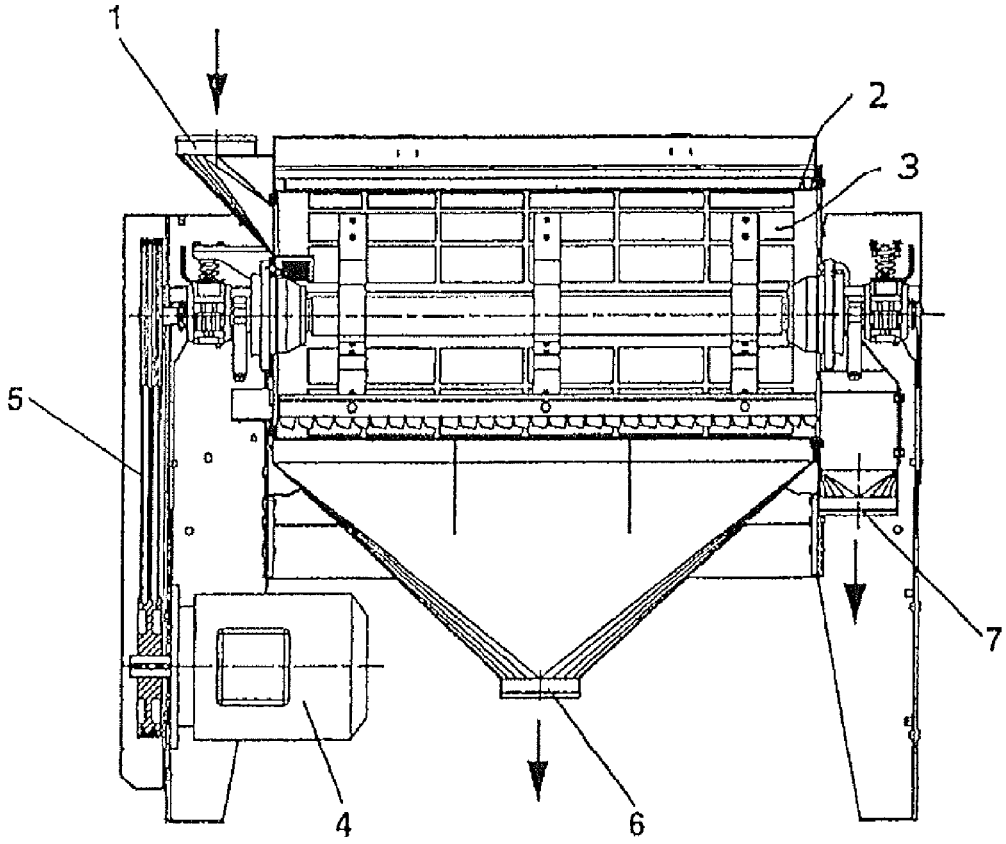
FIG. 1 shows a drum screening machine.

A drum screening machine shown in FIG. 1 has a product inlet 1 into a screening jacket 2. Arranged inside the screening jacket 2 is a rotating beater mechanism 3, which is driven by a motor 4 with a belt transmission 5.

The product is propelled against the screening jacket 2 by the rotating beater mechanism 3. The finer product passes through the screening jacket 2 and goes into a falling-through outlet 6, the coarser product leaves the screening jacket 2 or the drum screening machine through a reject outlet 7.

When screening/spinning flour, a product mixture that is difficult to separate is sifted and the screening jacket 2 has a supporting cage, which is surrounded by a screening cloth of polyester or polyamide filaments.

Figure 2:
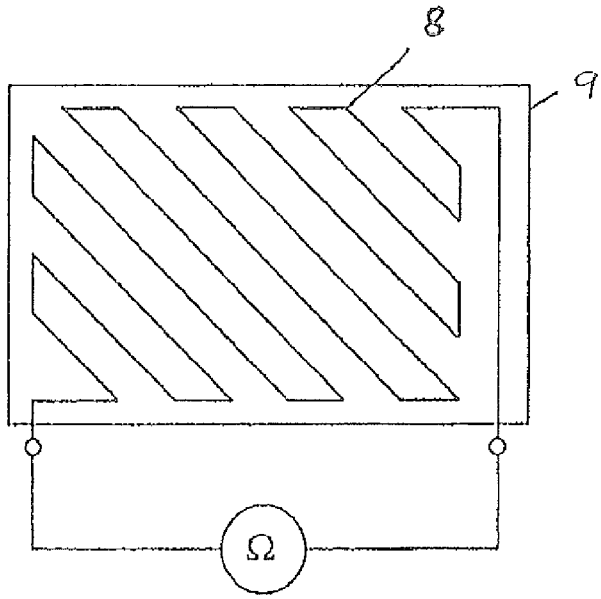
FIG. 2 shows a metallic cloth coating in a basic representation.

FIG. 2 shows by way of example the coating of a screen 9 with a conductive track 8 of silver. The layer thickness of the conductive track lies in the nanometer range, in particular in the range of approximately 20 to 800 nm, preferably from 60 to 650 nm, particularly preferably from 100 to 500 nm.

The arrangement of the conductive track diagonally in relation to the warp/weft threads of the cloth allows detection of damage on the basis of the structural path of the conductive track 8 to take place by evaluation of the measured resistance values in an electronic evaluation unit.

Figure 3:
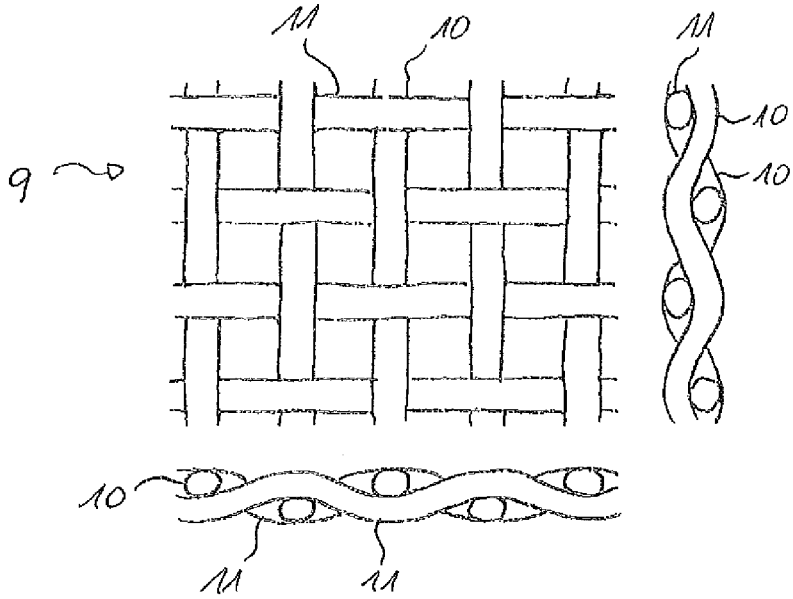
FIG. 3 shows a cloth in a basic representation.

To illustrate a possible cloth structure of a screen 9, FIG. 3 shows a square cloth comprising warp threads 10 and weft threads 11.

Figure 4:
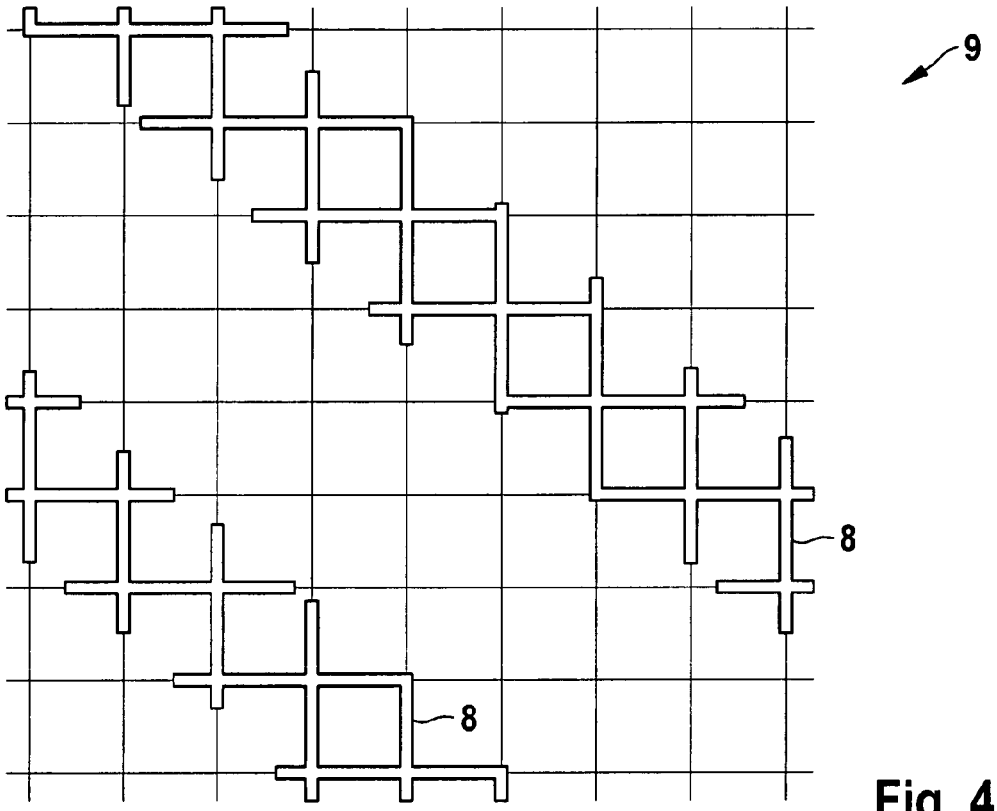
FIG. 4 shows an enlarged detail from FIG. 2.

In FIG. 4, an enlarged detail from FIG. 2 is schematically shown, the warp and weft threads also being represented. Methods known per se may be used for the coating.

Figure 5:
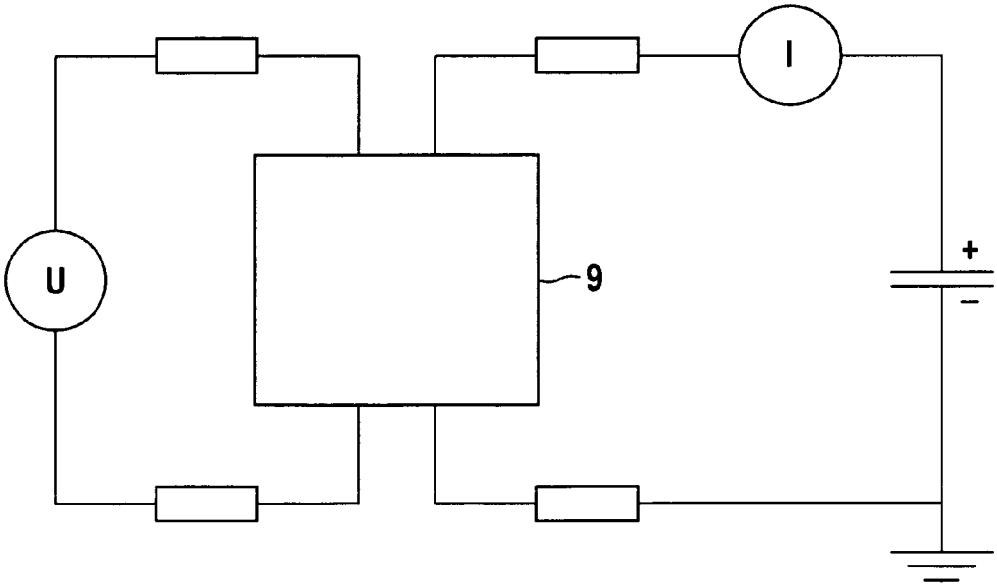
FIG. 5 shows a measuring arrangement.

FIG. 5 shows an exemplary test setup for measuring a screen 9 coated over its full surface area. On the right side of the diagram, the screen is connected to a voltage source. The screen resistance R can be determined on the basis of the applied voltage U and the measured current intensity I by way of Ohm's law $R=U/I$. In the intact state, the completely coated screen has a resistance R1. A damaged screen, which has a tear, rupture or abrasion, shows a resistance $R2 \neq R1$. Interruptions cause, for example, a resultant increase in the resistance, whereas local short-circuits cause a resultant decrease in the resistance. It is evident that the conductive track must be arranged in relation to the cloth structure of the screen in such a way that a continuous conductive track is obtained with the method as described above.

Further embodiments of the invention concern:

a) a screening machine, with a flat or round screen, the screen comprising a screening cloth of synthetic fibers, and the screening cloth being at least partially provided with a metallic layer;

b) a screening machine as described in a), the layer being formed in the manner of a conductive track as a serpentine resistance;

c) a screening machine as described in a), the layer being homogeneous;

d) a screening machine as described in a), b) or c), the layer consisting of silver or titanium;

e) a screening machine as described in a), b) or c), characterized in that the screen is formed as a round screening jacket in which a beater mechanism is rotatably arranged;

f) a method for operating a screen machine as described in a), b), c) or d), the electrical resistance of a layer being measured continuously or periodically.

The invention claimed is:

1. A screen with a screening cloth of synthetic material, wherein the screening cloth is at least partially provided with an electrically conductive layer, wherein the electrically conductive layer is not formed over the full surface area of the screening cloth, the electrically conductive layer is formed as a conductive track, and the conductive track runs substantially at an angle≠0° in relation to warp threads and weft threads of the cloth.

2. The screen as claimed in claim 1, wherein the electrically conductive layer is metallic.

3. The screen as claimed in claim 1, wherein the screening cloth is formed from synthetic fibers.

4. The screen as claimed in claim 1, wherein the synthetic material of the screening cloth is selected from the group comprising polyamides (PA); polyalkylenes; polyesters.

5. The screen as claimed in claim 2, wherein the metal(s) of the electrically conductive layer is/are selected from the group comprising silver, titanium, chromium and mixtures thereof.

6. The screen as claimed in claim 1, wherein the conductive track runs substantially transversely in relation to the delimitations of the screen openings.

7. The screen as claimed in claim 1, wherein the electrically conductive layer is homogeneous.

8. The screen as claimed in claim 1, wherein the screen is formed as a round screening jacket, in which a beater mechanism can be rotatably arranged.

9. A screening machine, containing a screen as claimed in claim 1.

* * * * *